United States Patent [19]

Johnson

[11] Patent Number: 4,920,950

[45] Date of Patent: May 1, 1990

[54] CAMP STOVE

[76] Inventor: Jimmy D. Johnson, Rte. 2, Box 355H, San Angelo, Tex. 76905

[21] Appl. No.: 301,016

[22] Filed: Jan. 24, 1989

[51] Int. Cl.[5] ..... F24B 3/00

[52] U.S. Cl. ..... 126/29; 126/9 R; 126/154

[58] Field of Search ..... 126/153, 154, 29, 30, 126/9 R, 25 R, 25 A

[56] References Cited

U.S. PATENT DOCUMENTS 2,791,959 5/1957 Pirz ..... 126/25 R 4,334,516 6/1982 Dittmer et al. ..... 126/9 R

*Primary Examiner*—Carroll B. Dority, Jr.

*Attorney, Agent, or Firm*—Robert C. Peterson

[57] ABSTRACT

A collapsible camp stove having a frame supporting a grate therein for cooking meat or other food. A pair of end plates attached to the frame by hinges which allow pivotal movement of the end plates between a collapsed and erected position. A latching means locks the end plates in the collapsed or erected positions. The grate is of expanded metal to provide better gripping of the food items. The frame has a handle for convenient carrying of the camp stove when collapsed. The handle may be recessed flush with the frame when not in use. A removable cooking plate is provided which contains one or more apertures for exposing less than all of a pot or pan seated over the aperture or apertures to direct heat of the camp fire while reducing exposure of the cook or sides of the pots or pans from direct exposure to the camp fire. The bottom edges of the end plates opposite the hinges have crescent cutouts to provide four point footing for the camp stove. The frame is designed in conjunction with the teardrop hinge plates to collapse into a compact, flat carrier secured by the latching means with rounded ends for safe handling. The cooking plate, when not in use, may be set up as a wind break along one side of the camp stove. The cooking plate has a convenient handle which lies flush on the cooking plate when the cooking plate is in place over the grate for cooking. The cooking plate is seated on the grate for storage and is held by the end plates in the collapse position of the camp stove.

10 Claims, 2 Drawing Sheets

CAMP STOVE

The present invention relates to a camp stove having a grate and removable cooking plate with contoured support plates adapted to support the Camp Stove over a camp fire at at least one height or folded over to secure the removable cooking plate in a stored relation. The Camp Stove has a handle for readily carrying in the collapsed position. A latching strap with a latching pin locks the support plates in place in the raised or lowered position.

BACKGROUND OF INVENTION

Heretofore various camp stoves and grills or the like have been proposed which provide portability to camp stoves, barbecue grills and the like. For example, U.S. Pat. No. 1,474,646 of A. W. Steen, patented Nov. 20, 1923, illustrates a tear down camp stove where the stove is completely disassembled into numerous flat metal plates. Thus, it is a knockdown stove which requires assembling and disassembling every time it is used. Other cooking grills have been proposed such as the one in U.S. Pat. No. 2,631,579 to Metzger, issued Mar. 17, 1953 which provides a portable cooking grill with pivotal metal plates that can be used either as a windbreaker or a skillet for meat and the like. The grill is held in place by four stake-like legs located at the corners. Such an arrangement has the disadvantage of not providing windbreak and cooking surface at the same time and obviously the legs must penetrate the surrounding terrain to provide support. U.S. Pat. No. 4,475,528 issued Oct. 9, 1984 to Gary W. Kerchinbroad describes a folding grill with detachable and storable legs.

It is apparent that the prior grills and portable cooking apparatus are of somewhat frail construction and require disassembling for storage or require a penetrable surface to secure in place such as necessary in Metzger.

SUMMARY OF THE INVENTION

In general, the present invention provides a portable and sturdy camp stove or grill, collapsible or foldable, as a compact self-form carrier which in use affords an optional grate or cooking plate surface of adjustable height above the camp fire. The camp stove includes hinged end plates that form four point footing which are locked by a positive latching mechanism in various positions for maintaining the desired height above the camp fire and also in the stored position.

It is therefor an object of the invention to provide a camp stove or grill which may be quickly and readily be set up for use over a campfire either as a grate for barbecue type grilling or with a cooking plate for cooking with pots and pans.

It is another object of the invention to provide a collapsible camp stove or grill with hinged plates forming a pair of legs with cutouts which provide four points which touch the terrain for easier levelling.

Another object of the invention is to provide a portable camp stove or grill with simple latching straps which secure end plate legs in various use or storage positions.

It is another object of the invention to provide a camp stove or grill with end plate legs secured to teardrop shaped hinge plates attached to the grate frame which allows more flexibility in height adjustment and the stored position.

It is another object of the invention to provide a camp stove or grill having a removable cooking plate which is secured in the stored position by the end plate legs folding on top thereof and held in place by the latching straps.

These and other objects and advantages of the invention will be readily apparent from the following specifications and claims in conjunction with the appended drawings:

Figure 1:
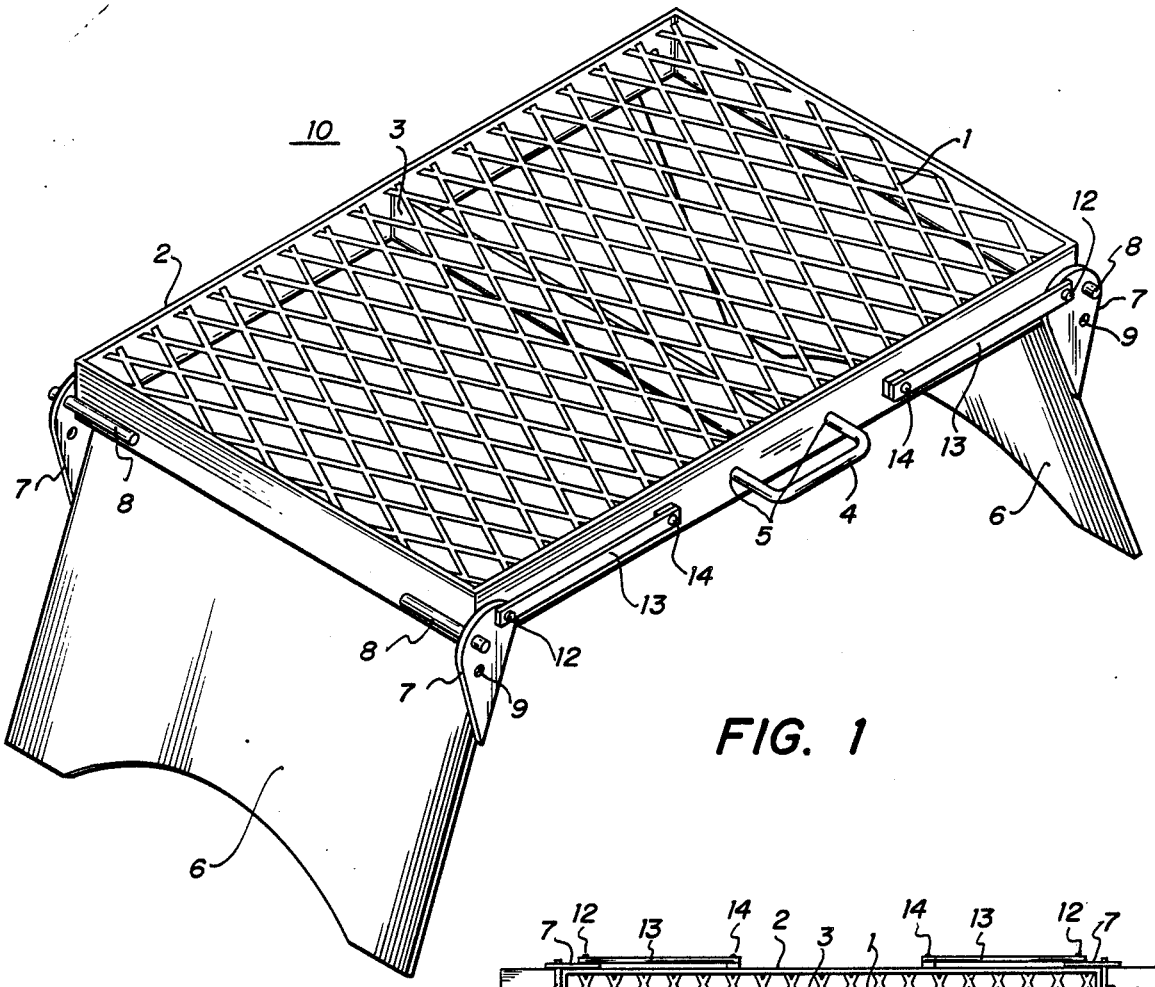
FIG. 1 is a view in prospectus of the Camp Stove or grill in the operating position with the cooking plate removed.
Figure 2:
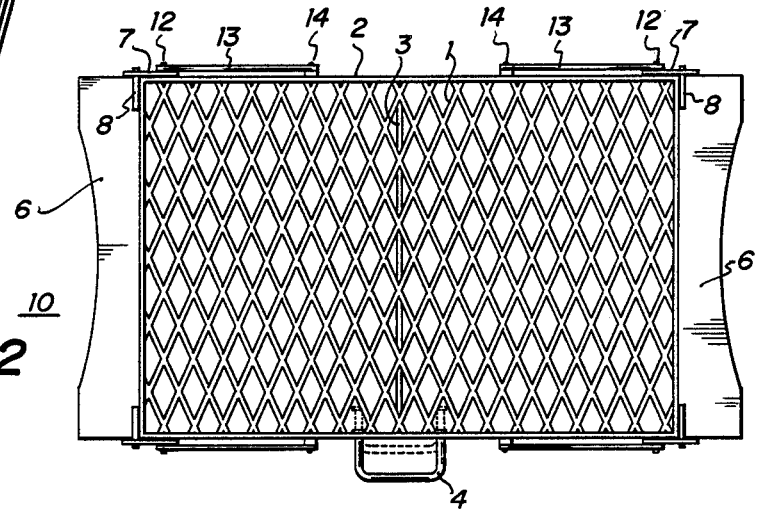
FIG. 2 is a top view of the grate or Camp Stove or grill with the cooking plate removed.
Figure 3:
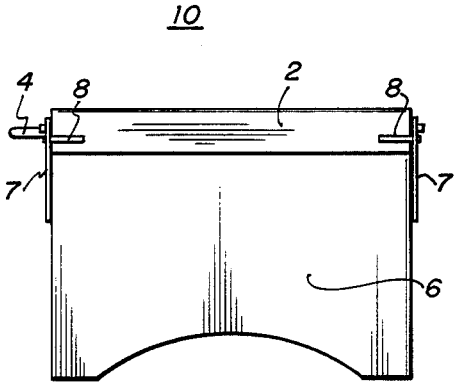
FIG. 3 is an end view of the Camp Stove or grill in FIG. 2.
Figure 4:
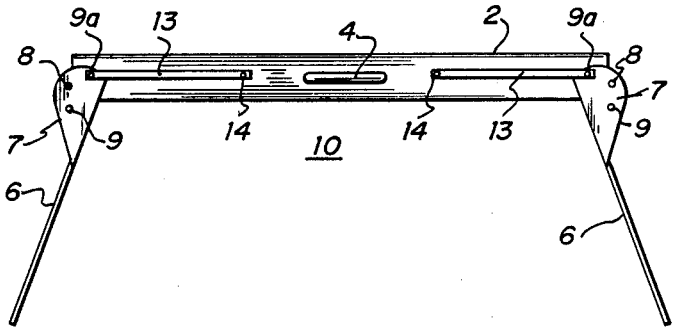
FIG. 4 is a side view of the cook stove or grill in FIG. 2 illustrating the teardrop hinges on the end plate legs.

It will be understood that the above drawing illustrates merely a preferred embodiment of the invention and that other embodiments are contemplated within the scope of the claims hereinafter set forth.

DETAILED DESCRIPTION OF THE INVENTION

Referring to the drawings and in particular FIGS. 1, 2, 3 and 4, the Camp Stove or grill 10 has a rectangular grate 1 having cross-sectional members which provide onmi-directional strength to the grate 1 and is held in a frame 2 which has a center brace 3. The grate 1 is preferable made with flat expanded metal, thus of lighter weight and greater strength. Of course, any suitable material may be used without departing from the scope of my invention. The frame 2 has attached handle 4 at one side of frame 2 which is attached through apertures 5 in the frame 2 such that the handle 4 may be pushed in flush against the side of frame 2 or extended to provide gripping space between the handle 4 and the frame 2. The grill 10 contains end plate legs 6 which are mounted to frame 2 by teardrop hinges 7 which are pivotally secured to hinge pins 8 which are affixed to frame 2 by welding or other suitable means. The teardrop hinges contain apertures **9*a* and 9*b* and the frame 2 contains apertures 11*a* and 11*b* which accommodate latch pins 12 of latching strap 13. Latching strap 13 is pivotally secured to frame 2 by studs 14**.

Figure 5:
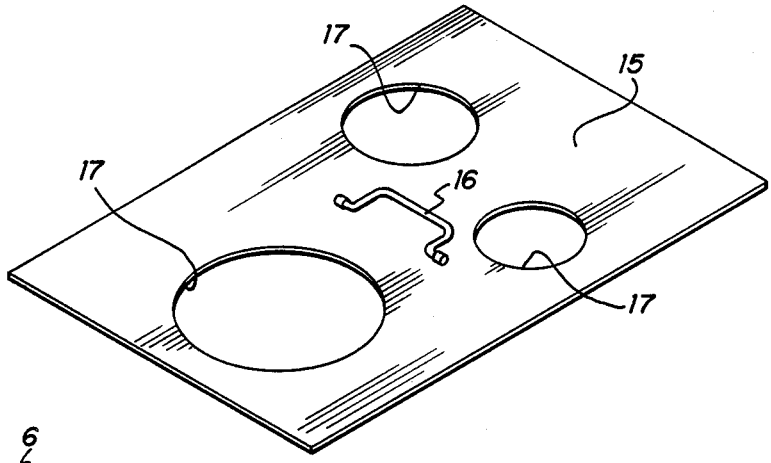
FIG. 5 is a prospectus view of the cooking plate which removably seats on the Camp Stove or grill in FIG. 1.
Figure 6:
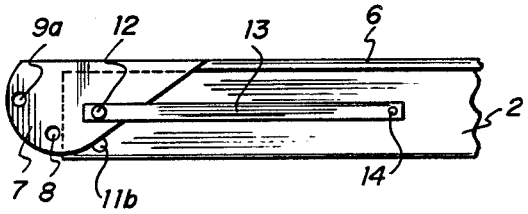
FIG. 6 is a half side view illustrating the teardrop hinge with the Camp Stove or grill in the folded position for transporting.

Referring to FIG. 5, cooking plate 15 has in its center a hinged handle 16 which folds down to be out of the way when cooking on the cooking plate. The cooking plate has three various size apertures 17 which provide an open area for placing a pan or a pot on the cooking plate, thus when in use, exposing the bottom of the utensils to direct heat from the fire without exposing the remainder of the cooking utensils or the cook to open flames from the fire through grate 1 or the apertures 17. Three such apertures 17 are illustrated, however, more or less of different sizes could be used without departing from the scope of the invention. Optionally, the cooking plate could be made of a flat plate without apertures. When the cooking plate 15 is not being used for cooking purposes as just described, it may be placed on either side of the cook stove 10 to reduce exposure of the camp fire to wind.

Figure 7:
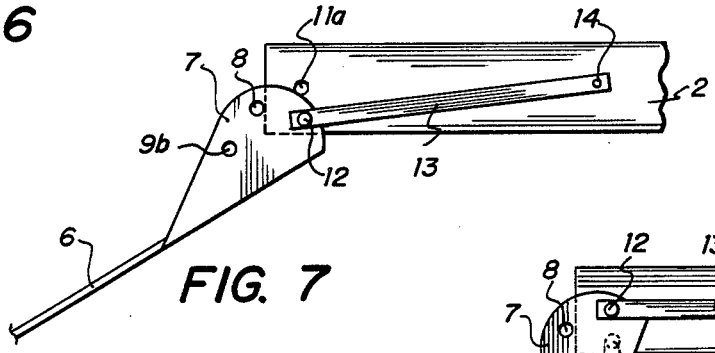
FIG. 7 is a detailed view of the teardrop hinge and Camp Stove or grill latching mechanism.
Figure 8:
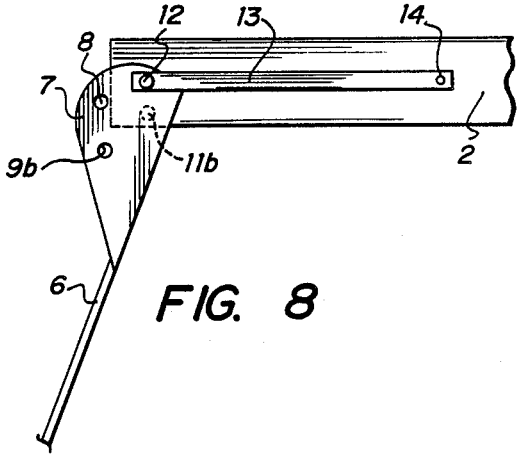
FIG. 8 illustrates the end plate in its most upright locked position for supporting the Camp Stove or grill over a campfire.

Referring to FIGS. 6, 7, 8 and 9, the end plate leg hinge functions will be described. The frame 2 has upper and lower apertures 11*a* and 11*b* respectively, which control the height of the cook stove above the campfire by supporting end plate legs 6 in the most upright position when the latching pin 12 is passed through aperture 9*a* of the teardrop hinge 7 and latched into upper aperture 11*a* in frame 2. Likewise, when the latching pin 12 is inserted through aperture 9*a* in teardrop hinge 7 into aperture 11*b* in frame 2, as shown in FIG. 7, the Camp Stove is at the lowest level.

Figure 9:
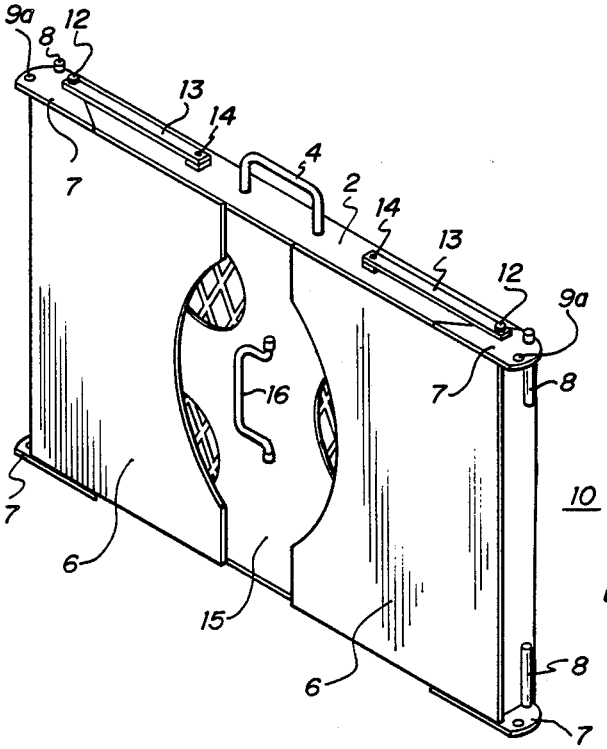
FIG. 9 is a prospectus view illustrating the Camp Stove or grill in the stored and carrying position with the cooking plate secured to the grate by the end plate legs in the stored and locked position of the hinge strap.

Referring particularly to FIG. 9, it will be noted that with cooking plate 15 retained in the folded grill, the latching pin 12 is inserted through aperture 9*b* and into aperture 11*a* of frame 2, the end plate legs 6 retain cooking plate 15 against the grate 1.

It will be appreciated that various changes and modification may be made in the above described camp stove without departing from the scope of the invention which is limited only by the scope of the following claims.

What is claimed is:

1. A collapsible Camp Stove with adjustable height cooking surface comprising:

a. A frame forming an opening extending therethrough over most of its interior and having a grate for supporting and exposing meat or other food to direct heat of a camp fire;

b. A pair of end plates having hinge plates at the upper ends thereof and hinged at opposed sides of said frame for pivotal movement between a collapsed position and at least one erected position, said end plates having cutouts at the unhinged bottom edges to form a four point footing;

c. A latch strap for each said end plate connected at one end to said frame and having a latch pin at an opposite end, said hinge plates having apertures adapted to be engaged by said latch pins to secure said end plates in the collapsed or erected positions; and d. A handle attached to the frame adapted to recess flush against the frame for carrying the Camp Stove.

2. The Camp Stove in claim 1 wherein the hinge plates are teardrop shaped.

3. The Camp Stove of claim 1 wherein the grate is of expanded metal construction with a central brace underlying the grate and affixed within the frame.

4. The Camp Stove of claim 1 wherein said end plates have crescent cutouts.

5. The Camp Stove of claim 1 wherein said latch pin is adapted to engage said apertures in the erected position to provide a low level and a high level height setting.

6. A collapsible Camp Stove with adjustable height cooking surface comprising:

a. A frame forming an opening extending therethrough over most of its interior and having a grate for supporting and exposing meat or other food to direct heat of a camp fire;

b. A pair of end plates having hinge plates at the upper ends thereof and hinged at opposed sides of said frame for pivotal movement between a collapsed position and at least one erected position, said end plates having cutouts at the unhinged bottom edges to form a four point footing;

c. A latch for each said end plate connected at one end to said frame and having a latch pin at an opposite end, said hinge plates having apertures adapted to be engaged by said latch pins to secure said end plates in the collapsed or erected positions;

d. A handle attached to the frame adapted to recess flush against the frame for carrying the Camp Stove; and e. a cooking plate adapted to be placed on the grate to provide protection from direct heat of the camp fire, said cooking plate having apertures for exposing the bottoms of pots and pans to direct heat.

7. The Camp Stove in claim 6 wherein the hinge plates are teardrop shaped.

8. The Camp Stove of claim 6 wherein the grate is of expanded metal construction with a central brace underlying the grate and affixed within the frame.

9. The Camp Stove of claim 6 wherein said end plates have crescent cutouts.

10. The Camp Stove of claim 6 wherein said latch pin is adapted to engage said apertures in the erected position to provide a low level and a high level height setting.

* * * * *